US008522908B1

(12) United States Patent
Collins et al.

(10) Patent No.: US 8,522,908 B1
(45) Date of Patent: Sep. 3, 2013

(54) PHOTOELECTRIC-ACTIVATED SWITCH FOR A MOTORIZED WHEELCHAIR

(71) Applicants: Richard Collins, Walnut Ridge, AR (US); Rick Gaither, Walnut Ridge, AR (US)

(72) Inventors: Richard Collins, Walnut Ridge, AR (US); Rick Gaither, Walnut Ridge, AR (US)

( * ) Notice: Subject to any disclaimer, the term of this patent is extended or adjusted under 35 U.S.C. 154(b) by 0 days.

(21) Appl. No.: 13/804,674

(22) Filed: Mar. 14, 2013

(51) Int. Cl.
*A61G 5/04* (2013.01)
*A61G 5/10* (2006.01)

(52) U.S. Cl.
USPC ... 180/272; 180/271; 280/304.1; 297/DIG. 4; 297/217.3; 340/573.1; 340/573.7

(58) Field of Classification Search
USPC ..... 180/271–273, 286, 287; 280/271–273, 280/280.1, 304.1; 297/DIG. 4, 217.1–217.3
See application file for complete search history.

(56) References Cited

U.S. PATENT DOCUMENTS

| | | | | |
|---|---|---|---|---|
| 3,752,928 | A * | 8/1973 | Flickinger | 381/103 |
| 4,196,425 | A * | 4/1980 | Williams et al. | 340/573.4 |
| 4,623,043 | A | 11/1986 | Babilas | |
| 6,204,767 | B1 * | 3/2001 | Sparks | 340/573.1 |
| 6,352,138 | B1 | 3/2002 | Duran et al. | |
| 6,431,572 | B1 | 8/2002 | Harden et al. | |
| 6,689,974 | B2 | 2/2004 | Guillot | |
| 6,788,206 | B1 * | 9/2004 | Edwards | 340/573.1 |
| 7,144,025 | B2 | 12/2006 | Wakita et al. | |
| 7,306,068 | B1 * | 12/2007 | Ray | 180/271 |
| 8,186,700 | B2 * | 5/2012 | Li et al. | 280/250.1 |
| 8,203,454 | B2 * | 6/2012 | Knight et al. | 340/573.1 |
| 2002/0070866 | A1 * | 6/2002 | Newham | 340/573.1 |

* cited by examiner

*Primary Examiner* — Ruth Ilan

(74) *Attorney, Agent, or Firm* — Montgomery Patent & Design; Robert C. Montgomery

(57) ABSTRACT

A motorized wheelchair kill switch for improving the safety of motorized wheelchairs is described. The motorized wheelchair kill switch includes a photoelectric sending unit and a photoelectric receiving unit that are used to kill the operation of a wheelchair joystick. The photoelectric sending unit emits a light beam toward the photoelectric receiving unit along a path that will be broken if a user is safely seated in the wheelchair. If the light beam is detected a determination is made that the user is not properly seated. In that case the joystick operation is disabled, locking the wheelchair motor and preventing accidental movement.

20 Claims, 3 Drawing Sheets

PHOTOELECTRIC-ACTIVATED SWITCH FOR A MOTORIZED WHEELCHAIR

RELATED APPLICATIONS

There are no current co-pending applications.

FIELD OF THE INVENTION

The presently disclosed subject matter relates to protective devices for motorized wheelchairs. More particularly, that subject matter relates to kill switches that automatically disable motorized wheelchair motors to prevent accidents.

BACKGROUND OF THE INVENTION

Handicapped and elderly people confined to wheelchairs face numerous obstacles in their daily lives. Some of those obstacles involve simple matters that those without handicaps or disabilities would not even notice. The simple act of traveling from one place to another can easily become a major undertaking that requires great effort and that may involve excessive risk.

Devices that reduce the difficulties of the handicapped and elderly traveling from one (1) place to another include the motorized wheelchair and its close relative the motorized scooter. Such devices and their equivalents are referred to hereinafter generically, including in the claims, as motorized wheelchairs. Recent developments in battery technology and motion controls have enabled the development of moderately priced motorized wheelchairs that can turn on a dime, move fractions of an inch, and provide nearly complete mobility, at least on level surfaces. Such motorized wheelchairs have been very successful and have aided numerous handicapped and elderly to lead more productive and enjoyable lives.

While very successful, motorized wheelchairs are not without problems. For example, a motorized wheelchair is typically controlled by a joystick that is mounted near the user's hand at the far end of an armrest. The term joystick as used herein, including in the claims, refers to any manually-operated control mechanism used by a wheelchair occupant to control motion. For example, touch pads may be used instead of joysticks to the same effect. Unfortunately, such joysticks are often located in about the same position where a handicapped or elderly person leans while reaching for something, to eat, or to perform any of a variety of daily tasks. When their torso or other body area contacts the joystick the motorized wheelchair can shoot forward and cause damage to nearly objects and possibly injury to the wheelchair occupant or bystanders.

Accordingly, there exists a need for a device which protects the occupant of a motorized wheelchair, bystanders and property. Beneficially such a device would be useful on a wide range of motorized wheelchair and scooters and would disable the motorized wheelchair to reduce or eliminate problems caused by a user coming into accidental contact with the joystick. Such a device that acts as a kill switch that disables a motorized wheelchair when its occupant is not fully seated would be particularly useful. As used herein a kill switch generically refers to the operation of effectively disabling the operation of a joystick. For example, by removing power or electronically locking out control by the joystick. The components that comprise a kill switch would ideally not cause discomfort and would not have exposed wiring. Such kill switches would ideally be retrofit or come as part of a new wheelchair.

SUMMARY OF THE INVENTION

The principles of the present invention provide for kill switches that protect occupants of motorized wheelchairs, bystanders and property from inadvertent damage and injury. Such kill switches are useful on a wide range of motorized wheelchairs and operate by disabling the wheelchairs when their occupants are not fully seated. The components that comprise the kill switches are beneficially padded so as not to cause discomfort to a user and such that there are no exposed wires. Such kill switches that can be retrofit onto existing wheelchairs or come as part of new wheelchairs.

A device that is in accord with the present invention is a kill switch that is wired into the main power circuit of a motorized wheelchair such that the wheelchair can only operate when the user is fully seated and leaning back. Should the occupant lean forward, the kill switch de-energizes the wheelchair to prevent movement even if the joystick is pushed. The kill switch can be provided as standard or optional equipment on new wheelchairs and may be provided as an add-on aftermarket retro-kit for installation on existing motorized wheelchairs.

A motorized wheelchair with kill switch that is in accord with the present invention includes a motorized wheelchair having a propulsion system, a first armrest, a second armrest, a back seat, a power source, a motion controller, and a joystick for directing the motion controller to control the motion of the motorized wheelchair. There is a first adjustable mounting bracket attached to the first armrest and a second adjustable mounting bracket attached to the second armrest. A photoelectric sending unit is attached to the first adjustable mounting bracket. The photoelectric sending unit is for emitting a light beam. There is a photoelectric receiving unit attached to the second adjustable mounting bracket for receiving the emitted light beam. Electrical power is applied from the power source to the photoelectric sending unit by a photoelectric sending unit cable, while a photoelectric receiving unit cable applies electrical power to the photoelectric receiving unit. The motorized wheelchair with kill switch further includes a relay for selectively applying electrical power to the motion controller if the photoelectric receiving unit does not receive the light beam.

Beneficially the first adjustable mounting bracket enables the photoelectric sending unit to be raised or lowered, and the photoelectric sending unit includes a light emitting lens assembly that projects light across the back seat. Preferably electrical power for the photoelectric receiving unit passes through a coil of the relay, which beneficially includes normally closed contacts.

A motorized wheelchair that is in accord with the present invention includes a propulsion system, a first armrest, a second armrest, a back seat, a power source, a motion controller, and a joystick for directing the motion controller to control the motion of the motorized wheelchair using electrical power from the power source. The motorized wheelchair further includes a first adjustable mounting bracket attached to the first armrest, a second adjustable mounting bracket attached to the second armrest, a photoelectric sending unit for emitting a light beam across the back seat which is attached to the first adjustable mounting bracket, a photoelectric receiving unit for receiving the emitted light beam which is attached to the second adjustable mounting bracket, and a power control means for selectively preventing motorized wheelchair motion based on an output of the photoelectric sending unit.

The motorized wheelchair can be configured such that the power control means prevents motorized wheelchair motion if the photoelectric sending unit receives the emitted light beam. Alternatively, the motorized wheelchair can be configured such that the power control means prevents motorized wheelchair motion if the photoelectric sending unit does not receive the emitted light beam. Preferably the motorized wheelchair includes a photoelectric sending unit cable for applying electrical power from the power source to the photoelectric sending unit and a photoelectric receiving unit cable for applying electrical power from the power source to the photoelectric receiving unit. In practice the power control means may include a relay for selectively applying electrical power to the motion controller if the photoelectric receiving unit does not receive the light beam. For convenience the relay has normally closed contacts, the first adjustable mounting bracket enables the photoelectric sending unit to be raised or lowered, and the photoelectric sending unit includes a light-emitting lens assembly.

A motorized wheelchair kill switch that is in accord with the present invention includes a first adjustable mounting bracket for attaching to a first armrest, a second adjustable mounting bracket for attaching to the second armrest, a photoelectric sending unit for emitting a light beam and for attaching to the first adjustable mounting bracket, a photoelectric receiving unit for receiving the emitted light beam and for attaching to the second adjustable mounting bracket, and a power control means for selectively preventing motorized wheelchair motion based on reception of the emitted light beam by the photoelectric sending unit.

The motorized wheelchair kill switch may include a flexible photoelectric sending unit cable for applying power to the photoelectric sending unit and a flexible photoelectric receiving unit cable for applying electrical power to the photoelectric receiving unit. In practice the power control means can include a power control relay configured such that electrical power to the photoelectric receiving unit passes through the power control relay. Preferably the power control relay has normally closed contacts.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
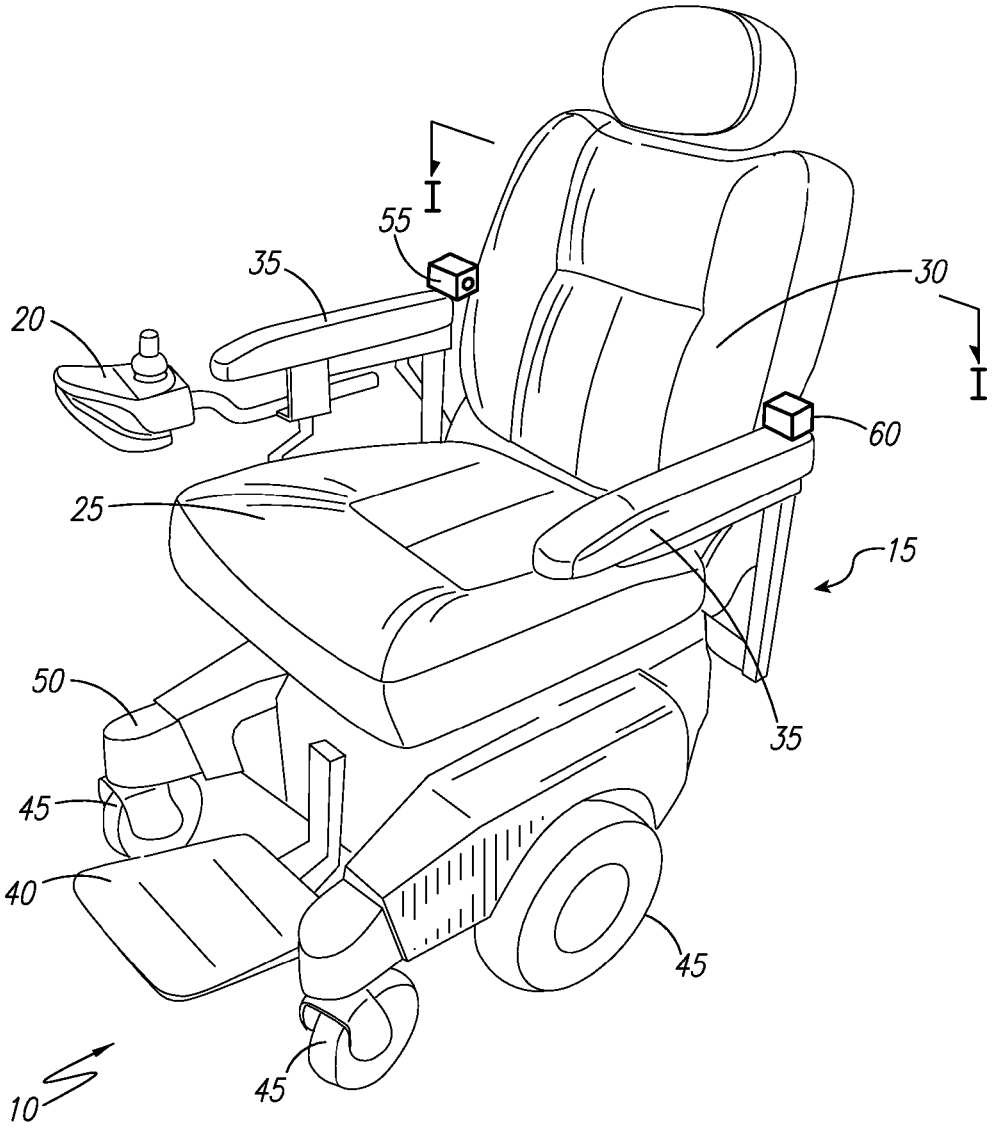
FIG. 1 is an isometric view of a motorized wheelchair kill switch 10 that is in accord with the preferred embodiment of the present invention when installed on a motorized wheelchair 15.

10 motorized wheelchair kill switch
15 motorized wheelchair
20 joystick
25 bottom seat
30 back seat
35 armrest
40 foot rest
45 wheel
50 propulsion system
55 photoelectric sending unit
60 photoelectric receiving unit
65 first adjustable mounting bracket
70 emitting lens assembly
75 light beam
80 flexible photoelectric sending unit cable
85 second adjustable mounting bracket
90 receiving lens assembly
95 flexible photoelectric receiving unit cable
100 on-board battery system
105 main control switch
110 relay coil
115 power control relay
120 relay contact
125 propulsion control module
130 first propulsion motor
135 second propulsion motor

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

FIG. 1 is an isometric view of a preferred embodiment motorized wheelchair kill switch 10 when installed on a motorized wheelchair 15. The motorized wheelchair 15 is intended to represent a generic motorized wheelchair that is operated by a joystick 20. Such motorized wheelchairs 15 can vary greatly in many details, thus the generic representation. It should be understood that the specifically illustrated motorized wheelchair 15 is not intended to be a limiting factor of the invention.

The motorized wheelchair 15 includes rather standard components such as a bottom seat 25, a back seat 30, armrests 35, a foot rest 40, wheels 45, and a propulsion system 50. However, the motorized wheelchair 15 also includes a photoelectric sending unit 55 and a photoelectric receiving unit 60 that are located on armrests near the back seat 30 as shown.

The photoelectric sending unit 55 and the photoelectric receiving unit 60 can be mounted on either the left or right side and thus the indicated positional placement is not intended to be a limiting factor of the present invention. Further disclosures of the photoelectric sending unit 55 and the photoelectric receiving unit 60 are provided below. It is envisioned that the motorized wheelchair kill switch 10 would be provided as standard or optional equipment on new motorized wheelchair 15. It might also be provided as an add-on aftermarket kit for installation onto existing electric motorized wheelchairs 15.

Figure 2:
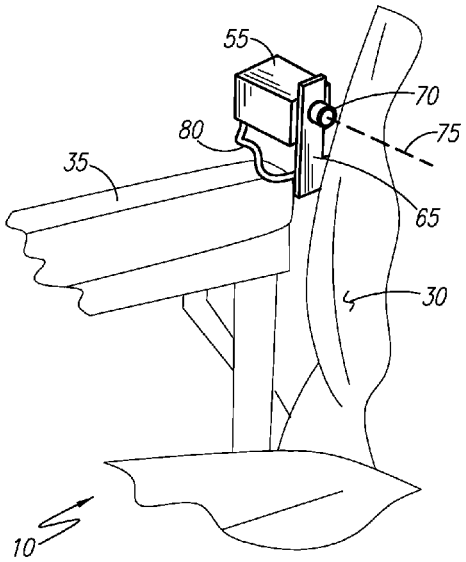
FIG. 2 is a detailed view of the photoelectric sending unit 55 of the motorized wheelchair kill switch 10 shown in FIG. 1.

FIG. 2 presents a detailed view of the photoelectric sending unit 55 attached to the motorized wheelchair 15. The photoelectric sending unit 55 is mounted upon a first adjustable mounting bracket 65 that is attached to one (1) armrest 35. The first adjustable mounting bracket 65 allows the photoelectric sending unit 55 to be raised or lowered to compensate for different sized occupants of the motorized wheelchair 15. The photoelectric sending unit 55 includes a light emitting lens assembly 70 which projects a light beam 75 across, but slightly elevated with respect to, the back seat 30. The photoelectric sending unit 55 includes a flexible photoelectric sending unit cable 80 for receiving electrical power as is subsequently described. It is envisioned that the photoelectric sending unit 55 uses either visible or infrared light and that it includes a photoelectric emitter that can be emit light that can be detected at least two feet (2 ft.) away.

The position of the photoelectric sending unit 55 is preferably adjusted such that it does not interfere with a user's elbow or such that the photoelectric sending unit 55 is detrimental, annoying or aggravating.

Figure 3:
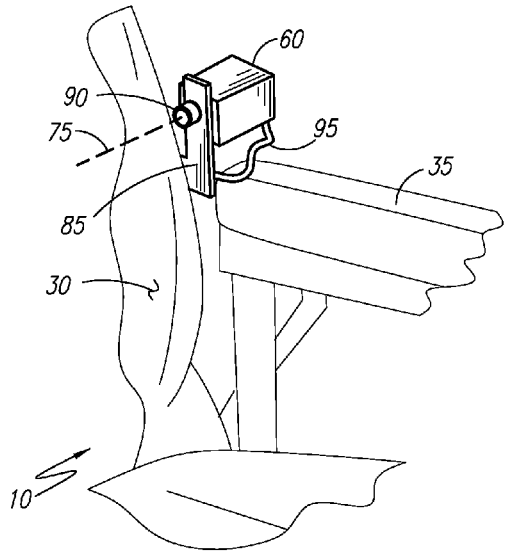
FIG. 3 is a detailed view of the photoelectric receiving unit 60 of the motorized wheelchair kill switch 10 shown in FIG. 1.

FIG. 3 presents a detailed view of the photoelectric receiving unit 60 attached to the motorized wheelchair 15. The photoelectric receiving unit 60 is mounted on a second adjustable mounting bracket 85 that is attached to another armrest 35. The second adjustable mounting bracket 85 allows the photoelectric receiving unit 60 to be raised or lowered to compensate for different sized motorized wheelchair 15 occupants. The photoelectric receiving unit 60 includes a receiving lens assembly 90 that is capable of receiving the light beam 75 emitted by the photoelectric sending unit 55 (see FIG. 2). The photoelectric receiving unit 60 is provided with a flexible photoelectric receiving unit cable 95 for receiving electrical power. Further disclosure of the flexible photoelectric receiving unit cable 95 is provided below.

The position of the photoelectric receiving unit 60 is such that is it should not interfere with the user's elbow or in fact be detrimental, annoying or aggravating. The operation of the motorized wheelchair kill switch 10 ideally would be automatic whenever the propulsion system 50 (see FIG. 1) is operational.

Figure 4:
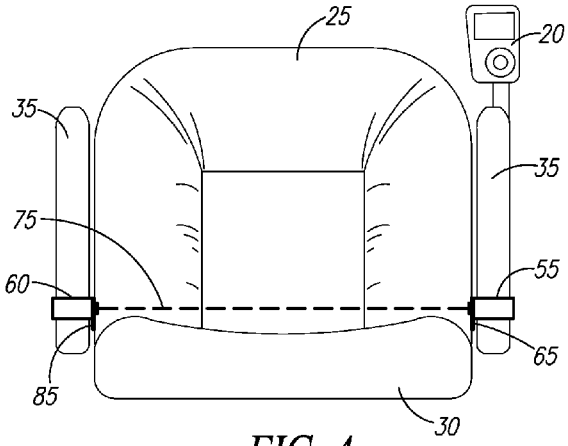
FIG. 4 is a sectional view of the motorized wheelchair kill switch 10 taken along line I-I, of FIG. 1; and, FIG. 5 is a simplified electrical schematic diagram of the motorized wheelchair kill switch 10 shown in FIG. 1.

FIG. 4 presents a sectional view of the motorized wheelchair kill switch 10 as seen along section line I-I of FIG. 1. Specifically, FIG. 4 shows the view looking down on the top of the motorized wheelchair 15 when standing slightly behind it. As noted the photoelectric sending unit 55 is attached to one of the armrests 35 via the first adjustable mounting bracket 65, while the photoelectric receiving unit 60 photoelectric sending to the other armrest 35 via the second adjustable mounting bracket 85. The light beam 75 extends between the photoelectric sending unit 55 and the photoelectric receiving unit 60, in front of the back seat 30 and well above the bottom seat 25.

Should an occupant of the motorized wheelchair 15 sit against the back seat 30 the light beam 75 will be broken. When the light beam 75 is broken the motorized wheelchair 15 (see FIG. 1) can be controlled by the joystick 20 (described below) in the normal fashion. Should the occupant lean forward or otherwise become displaced from the back seat 30, the light beam 75 will be intact and will be received by the photoelectric receiving unit 60. Reception of the light beam 75 will prevent operation by the joystick, thus causing the movement of the motorized wheelchair 15 to cease as described below.

Figure 5:
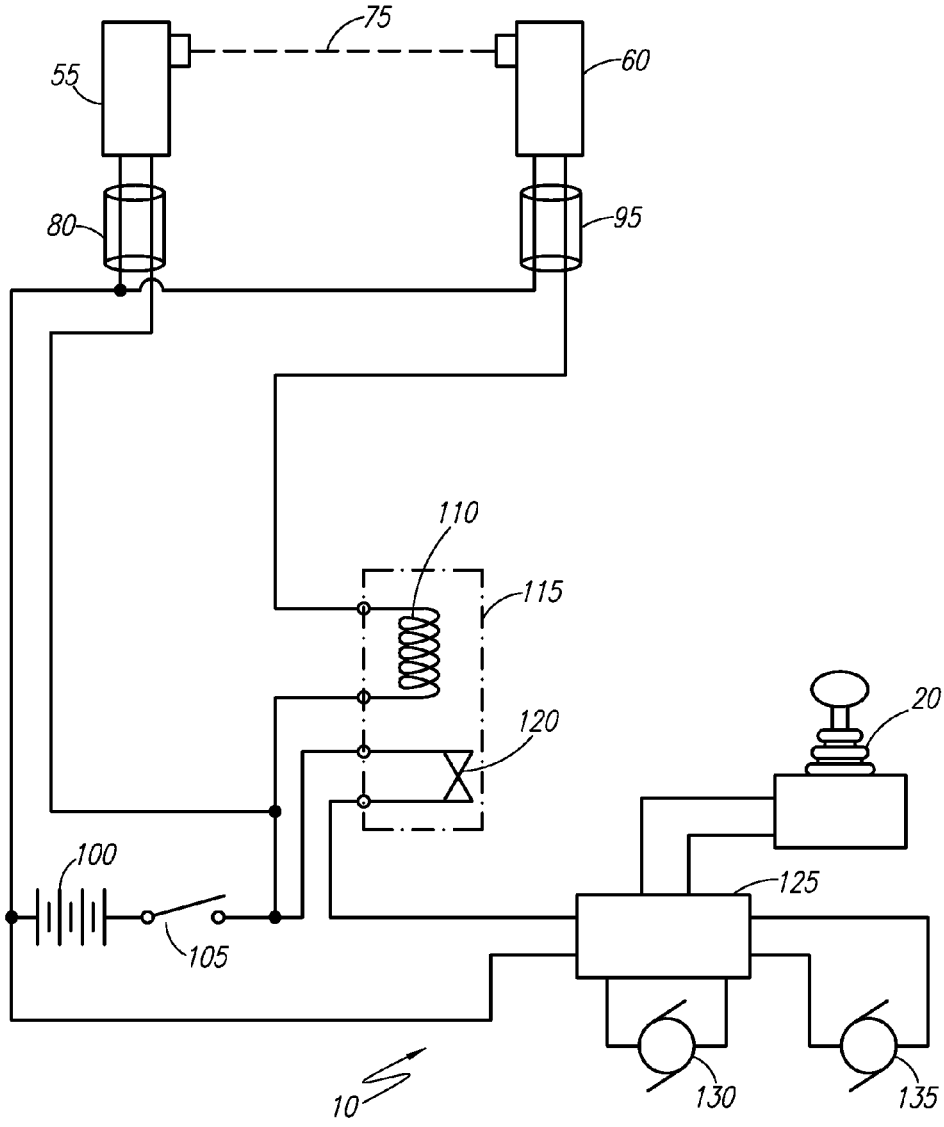

FIG. 5 depicts the major electrical components of the motorized wheelchair kill switch 10 in a functional electrical schematic diagram format. Electrical power for the motorized wheelchair 15 is derived from an on-board battery system 100, as is normal for a motorized wheelchair 15 (see FIG. 1). That electrical power is routed through a main control switch 105 such as would normally be present on a motorized wheelchair 15 (see FIG. 1). The main control switch 105 may be a key-operated switch to prevent un-authorized use of the motorized wheelchair 15 (see FIG. 1).

The electrical power from the load side of the main control switch 105 is applied to the photoelectric sending unit 55 via the flexible photoelectric sending unit cable 80. In response, the photoelectric sending unit 55 emits the light beam 75. The photoelectric receiving unit 60 is powered by electrical power that passes through a relay coil 110 and the photoelectric receiving unit cable 95. If the light beam 75 is received by the photoelectric receiving unit 60 the resistance of the photoelectric receiving unit 60 drops. This causes increased electrical current to flow through the relay coil 110 and the photoelectric receiving unit cable 95. This causes the relay 115 to switch states, opening up its normally closed electrical contact, and thus removing electrical power from a propulsion control module 125. With no electrical power applied to the propulsion control module 125 the motion controlling operation of the joystick 20 is killed since there is no electrical power available for a first propulsion motor 130 and/or a second propulsion motor 135.

In contrast, if the light beam 75 is broken by an occupant properly seated in the motorized wheelchair 15 the photoelectric receiving unit 60 does not receive the light beam 75. Thus causes the photoelectric receiving unit 60 to have a high resistance, which only allows a small amount of current to pass through the relay coil 110 and along the flexible photoelectric receiving unit cable 95. This causes the relay coil 110 to be de-energized, which places the power control relay 115 in its normally-closed state such that the contacts 120 are closed. The propulsion control module 125 then receives electrical power. Movement commands from the joystick 20 then can be followed by the propulsion control module 125 by the application of appropriate power to the first propulsion motor 130 and/or the second propulsion motor 135 to fulfill the joystick commands.

The foregoing functional description is simply one (1) of an almost infinite number of electronic ways to kill the operation of the joystick 20. For example, the photoelectric receiving unit 60 might apply one (1) logic level to a microcontroller port or to another logic network if the light beam 75 is detected or the other logic level if the light beam 75 is not detected. Then software controlling the microcontroller or the other logic network could cause the desired killing of the joystick 20 commands in a multitude of ways. Whatever the actual implementation, the desired result is that reception of the light beam 75 by the photoelectric receiving unit 60 kills the operation of the joystick.

While the preferred embodiment motorized wheelchair kill switch 10 only allows joystick 20 controlled operation of the motorized wheelchair 15 if the light beam 75 is not received, in some embodiments the opposite may be true. For example, if the photoelectric receiving unit 60 and the photoelectric sending unit 55 are located in front of a seated wheelchair occupant the joystick 20 may control, but if the wheelchair occupant leans forward to break the light beam 75 joystick 20 operation might be killed. However, the preferred embodiment as illustrated and described is far safer in most applications as an occupant getting into the motorized wheelchair 15 will not accidently cause joystick operations.

The preferred embodiment of the present invention can be utilized by the common user in a simple and effortless manner with little or no training. It is envisioned that the motorized wheelchair kill switch 10 would be constructed in general accordance with FIG. 1 through FIG. 5. As described, the motorized wheelchair kill switch 10 could be provided as standard or as optional equipment on new motorized wheelchair 15, or it could be provided as an add-on aftermarket kit for existing motorized wheelchairs 15. The aftermarket kit would consist of the photoelectric sending unit 55, the flexible photoelectric sending unit cable 80, the first adjustable mounting bracket 65, the photoelectric receiving unit 60, the flexible photoelectric receiving unit cable 95, the second adjustable mounting bracket 85, the power control relay 115, and associated mechanical components such as fasteners, and associated electrical components such as wiring and terminals.

In use the motorized wheelchair kill switch 10 is transparent to the user of the motorized wheelchair 15. He or she would be instructed that the motorized wheelchair 15 is only operational when fully seated and upright against the back seat 30. Minor variations to accommodate users of different sized can be made by sliding both the photoelectric sending unit 55 and the photoelectric receiving unit 60 up or down on the first adjustable mounting bracket 65 and the second adjustable mounting bracket 85 respectively. Once properly adjusted the motorized wheelchair kill switch 10 is ready for operation.

With the motorized wheelchair kill switch 10 installed the operation of the motorized wheelchair 15 is only possible when the user of the motorized wheelchair 15 is seated upright. Should the user reach forward to grasp something and accidentally contact the joystick 20 in any way, operation of the motorized wheelchair 15 is disabled. The user simply sits backward and upright to re-enable operation and allow for continued and repeated use.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A motorized wheelchair with kill switch, comprising:

a motorized wheelchair having a propulsion system, a first armrest, a second armrest, a back seat, a power source, a motion controller, and a joystick for directing said motion controller to control the motion of said motorized wheelchair;

a first adjustable mounting bracket attached to said first armrest;

a second adjustable mounting bracket attached to said second armrest;

a photoelectric sending unit attached to said first adjustable mounting bracket, said photoelectric sending unit for emitting a light beam;

a photoelectric receiving unit attached to said second adjustable mounting bracket, said photoelectric receiving unit for receiving said emitted light beam;

a photoelectric sending unit cable for applying electrical power from said power source to said photoelectric sending unit;

a photoelectric receiving unit cable for applying electrical power from said power source to said photoelectric receiving unit; and, a relay for selectively applying electrical power to said motion controller if said photoelectric receiving unit does not receive said light beam.

2. The motorized wheelchair with kill switch according to claim 1, wherein said first adjustable mounting bracket enables said photoelectric sending unit to be raised or lowered.

3. The motorized wheelchair with kill switch according to claim 2, wherein said photoelectric sending unit includes a light emitting lens assembly that projects light across said back seat.

4. The motorized wheelchair with kill switch according to claim 2, wherein said electrical power through said photoelectric receiving unit cable passes through a coil of said relay.

5. The motorized wheelchair with kill switch according to claim 4, wherein said relay has normally closed contacts.

6. A motorized wheelchair having a propulsion system, a first armrest, a second armrest, a back seat, a power source, a motion controller, and a joystick for directing the motion controller to control the motion of the motorized wheelchair using electrical power from said the power source, the motorized wheelchair further including;

a first adjustable mounting bracket attached to the first armrest;

a second adjustable mounting bracket attached to the second armrest;

a photoelectric sending unit for emitting a light beam across the back seat, said photoelectric sending unit attached to said first adjustable mounting bracket;

a photoelectric receiving unit for receiving said emitted light beam, said photoelectric receiving unit attached to said second adjustable mounting bracket; and, a power control means for selectively preventing motorized wheelchair motion based on an output of said photoelectric sending unit.

7. The motorized wheelchair according to claim 6, wherein said power control means prevents motorized wheelchair motion if said photoelectric sending unit receives said emitted light beam.

8. The motorized wheelchair according to claim 6, wherein said power control means prevents motorized wheelchair motion if said photoelectric sending unit does not receive said emitted light beam.

9. The motorized wheelchair according to claim 8, further including a photoelectric sending unit cable for applying electrical power from said power source to said photoelectric sending unit.

10. The motorized wheelchair according to claim 9, further including a photoelectric receiving unit cable for applying electrical power from said power source to said photoelectric receiving unit.

11. The motorized wheelchair according to claim 6, wherein said power control means includes a relay selectively applying electrical power to the motion controller if said photoelectric receiving unit does not receive said light beam.

12. The motorized wheelchair according to claim 11, wherein said relay has normally closed contacts.

13. The motorized wheelchair according to claim 6, wherein said first adjustable mounting bracket enables said photoelectric sending unit to be raised or lowered.

14. The motorized wheelchair according to claim 6, wherein said photoelectric sending unit includes a light emitting lens assembly.

15. A motorized wheelchair kill switch, comprising:

a first adjustable mounting bracket for attaching to a first armrest;

a second adjustable mounting bracket for attaching to a second armrest;

a photoelectric sending unit for emitting a light beam, said photoelectric sending unit for attaching to said first adjustable mounting bracket;

a photoelectric receiving unit for receiving said emitted light beam, said photoelectric receiving unit for attaching to said second adjustable mounting bracket; and, a power control means for selectively preventing motorized wheelchair motion based on reception of said emitted light beam by said photoelectric sending unit.

16. The motorized wheelchair kill switch according to claim 15, further including a flexible photoelectric sending unit cable for applying power to said photoelectric sending unit.

17. The motorized wheelchair kill switch according to claim 16, further including a flexible photoelectric receiving unit cable for applying electrical power to said photoelectric receiving unit.

18. The motorized wheelchair kill switch according to claim 17, wherein said power control means includes a power control relay.

19. The motorized wheelchair kill switch according to claim 18, wherein said electrical power to said photoelectric receiving unit passes through said power control relay.

20. The motorized wheelchair kill switch according to claim 19, wherein said power control relay has normally closed contacts.

* * * * *